US012110787B2

(12) United States Patent
Huseby

(10) Patent No.: US 12,110,787 B2
(45) Date of Patent: Oct. 8, 2024

(54) RESERVOIR INFLOW MONITORING

(71) Applicant: Resman AS, Ranheim (NO)

(72) Inventor: Olaf Kristoffer Huseby, Ranheim (NO)

(73) Assignee: RESMAN AS, Ranheim (NO)

( * ) Notice: Subject to any disclaimer, the term of this patent is extended or adjusted under 35 U.S.C. 154(b) by 69 days.

(21) Appl. No.: 17/483,269

(22) Filed: Sep. 23, 2021

(65) Prior Publication Data

US 2022/0098975 A1 Mar. 31, 2022

(30) Foreign Application Priority Data

Sep. 25, 2020 (GB) ..... 2015238

(51) Int. Cl.
*E21B 47/13* (2012.01)
*E21B 47/11* (2012.01)

(52) U.S. Cl.
CPC ..... *E21B 47/11* (2020.05)

(58) Field of Classification Search
None
See application file for complete search history.

(56) References Cited

U.S. PATENT DOCUMENTS

2010/0147066 A1 6/2010 Ziauddin
2013/0245948 A1* 9/2013 Nyhavn ..... E21B 43/14 702/6
2016/0047231 A1* 2/2016 Nyhavn ..... E21B 43/16 166/254.1

FOREIGN PATENT DOCUMENTS

EP 2633152 B1 7/2016
WO WO2001/92685 A1 12/2001
WO WO2012/057634 A1 5/2012
WO WO2018/143814 A1 11/2018

* cited by examiner

*Primary Examiner* — Charles R Nold
(74) *Attorney, Agent, or Firm* — FisherBroyles, LLP

(57) ABSTRACT

A method and system estimates an influx profile for at least one well fluid from a reservoir to a producing petroleum well with two or more influx zones or influx locations to a production flow. The method includes installing at least one tracer source with distinct tracer materials in known levels of the well and transporting tracer molecules from the tracer sources in the well into the reservoir. The method also includes inducing production flow in the well from the reservoir into the well, collecting samples downstream of the two or more influx zones at known sampling times and analyzing samples for concentration and type of tracer material from said possible tracer sources. The contribution of flow from the two or more influx zones may be calculated based on the analyzed tracer concentrations.

14 Claims, 10 Drawing Sheets

RESERVOIR INFLOW MONITORING

The present invention relates to apparatus and method for reservoir monitoring using tracers. Aspects of the invention include a system to monitor characteristics of flow in a producing well. Aspects of the invention also include estimating the distribution of inflow rates in hydrocarbon production wells.

BACKGROUND TO THE INVENTION

Downhole tracers released into the production flow in a producing well has been previously used for estimating which fluids flow in parts of the well.

Methods of monitoring fluid rate based on transient flow where distinct tracers are arranged at different influx zones in a well are known. EP2633152 discloses a method of estimating influx profile for well fluids to petroleum well. The method comprises inducing a transient in the production rate of the entire production flow by shutting in the well. The well is shut-in for a period of time to allow a high concentration of tracers to build up in the well and then the well is re-started to carry the tracers to surface. Sampling and analysis of the concentration of the different tracers is used to provide qualitative and quantitative production data.

However, these methods limit the number of opportunities for obtaining tracer data, as shutting in the well is a complex and highly expensive operation requiring significant project planning and resulting in loss of revenue due to interruption to production.

Regularly restarting a well after a shut in may present risks to the well infrastructure. Forcing the fluid column in the well to start moving after a long period of rest may lead to very complex pressure, flow rate and temperature changes in the infrastructure. The sudden changes can pose a real threat to equipment, in the worst case, permanently impairing production or even requiring recompleting or sidetracking the well.

It may also be problematic lifting a column of heavy fluids when restarting a well after a shut in. In some cases restarting a well may not be possible.

The above systems require the capture of tracer data released during or shortly after well restart. High frequency sampling must be regularly taken to ensure that the transient tracer data is captured. If samples are not taken at sufficient frequency or over a long enough period, aspects of the tracer data may be lost.

SUMMARY OF THE INVENTION

It is amongst the aims and objects of the invention to provide a method and system for monitoring downhole zonal contributions of well fluid to production flow in a petroleum production well.

It is another object of the present invention to provide a tracer release system for selectively placing or pumping tracers into the reservoir through specific influx locations to allow production flow measurement and wellbore inflow profiles to be calculated and monitored.

It is a further object of an aspect of the invention to provide a method and system for estimating the distribution of inflow rates during steady state conditions in oil and gas wells without requiring the well to be shut in.

Further aims and objects of the invention will become apparent from reading the following description.

According to a first aspect of the invention, there is provided a method of estimating an influx profile for at least one well fluid from a reservoir to a producing petroleum well with two or more influx zones or influx locations to a production flow;

wherein the method comprises installing tracer sources with distinct tracer materials in known levels of the well;

transporting tracer molecules from the tracer sources into the reservoir;

inducing production flow from the reservoir into the well;

collecting samples downstream of the two or more influx zones at known sampling times;

analysing samples for concentration and type of tracer material from said possible tracer sources; and based on the analysed concentrations calculating contribution of flow from the two or more influx zones.

The at least one of said tracer sources may be arranged downstream and exposed to the fluids in at least one of the influx zones.

The at least one well fluid may be at least one of oil, gas and/or water. The method may comprise measuring the at least one well fluid downstream of the influx locations such as at surface. The method may comprise measuring the rate of each phase downstream of the influx locations such as at surface.

By providing tracer sources at known positions in the well the distinct tracer molecules may be accurately transported into precise areas of the reservoir so that they can return through selected influx locations into the well during production. This may allow characterisation of the reservoir.

The tracer sources may be installed by arranging, fixing and/or immobilising tracer sources in the well. The at least one tracer release apparatus may be installed downstream or upstream of each influx zone. The at least one tracer release apparatus may be installed adjacent to the influx zone. The at least one tracer release apparatus may be installed upstream or downstream of at least one isolation apparatus configured to isolate at least one of the influx zones.

The method may comprise inducing production to allow tracer molecules in the reservoir to enter the production flow through their specific influx zones and propagate downstream with the production flow. The method may comprise inducing a steady state flow. The method may comprise inducing a steady state flow condition in the production rate of the entire production flow or for at least one of the influx zones. The method may comprise adjusting the production flow to a different steady state flow.

The method may comprise inducing multiple steady state flow conditions in the production rate of the entire production flow or for at least one of the influx zones and collecting samples.

The tracer may be detectable downstream of the influx location and/or topside as tracer response signal and/or spike at the downstream detection point.

The method may comprise releasing tracer molecules from the tracer source into the well and/or annulus at an even release rate. The method may comprise releasing tracer molecules from the tracer source into the well and/or annulus at a known release rate. The method may comprise building a high or increased concentration of tracer molecules in the well and/or annulus prior to transporting the tracer molecules from the tracer sources into the reservoir.

The method may comprise transporting tracer molecules into the reservoir through at least one influx zone or influx location. The method may comprise transporting tracer molecules into the reservoir through each of the two or more influx zones or influx locations. The method may comprise transporting a first type of tracer through a first influx zone and a second type of tracer through a second influx zone. The method may comprise transporting the tracer molecules through each zones or influx locations sequentially or simultaneously. The method may comprise transporting the tracer molecules through more than one of the influx zones or influx locations at a time.

The method may comprise transporting the tracer molecules from the well into the reservoir by pumping a fluid downhole to push the tracer molecules into the reservoir through the two or more influx zones or influx locations. The method may comprise transporting distinct tracer molecules through each influx zone.

The method may comprise transporting a known volume of the at least one tracer into the reservoir. The method may comprise transporting a known volume of well fluid containing tracer molecules released from the tracer source into the reservoir.

The method may comprise isolating at least one influx zone or influx location in the well before transporting the tracer molecules from the well into the reservoir. The method may comprise isolating each influx zone or influx location and transporting the tracer molecules at that influx zone or influx location into the reservoir sequentially.

The method may comprise collecting samples before, during and/or after a steady state production flow rate.

The method may comprise calculating rate fractions from each influx location into the production flow using mass conservation equations.

One or more of the method steps may be repeated to estimate an influx profile for at least one well fluid from a reservoir to a producing petroleum well at different points in time. The method or one or more steps of the method may be repeated periodically.

One or more of the method steps may be repeated and the contribution of flow from the two or more influx zones may be adjusted.

According to a second aspect of the invention, there is provided a system for estimating an influx profile for at least one well fluid (oil, gas, water) from a reservoir to a producing petroleum well with two or more influx zones or influx locations to a production flow, the system comprising:

at least one tracer release apparatus comprising a tracer source with distinct tracer material configured to be installed in known levels of the well;

at least one isolation device arranged in the well to isolate at least one of said influx zones from the remaining influx zones.

The system may comprise a sampling device for collecting samples downstream of the two or more influx zones at known sampling times. The sampling device may be a real time sampling probe.

The system may comprise a tracer analyser for analysing samples concentration and type of tracer material from said possible sources.

The tracer sources may be installed in known levels of the well by arranging the tracer sources in tracer release apparatus mountable in the annulus, in or on the production tubing or other components of the completion. The tracer release apparatus may be arranged, installed and/or mounted at known locations near each influx location.

The tracer release apparatus may be configured to release tracer into the well at an even release rate. The tracer release apparatus may be configured to release tracer at a known release rate.

The at least one tracer release apparatus may be arranged downstream or upstream of each influx zone. The at least one tracer release apparatus may be arranged adjacent to the influx zone. The at least one tracer release apparatus may be arranged uphole or downhole of at least one isolation apparatus configured to isolate at least one of the influx zones.

The tracer release apparatus may be configured to hold the tracer material against the outside wall of the production tubing, in the annulus and/or against the formation. The tracer release apparatus may be configured to outwardly vent and/or inwardly vent tracer. The tracer release apparatus may be configured to outwardly vent tracer into the annulus. The tracer release apparatus may be a mechanical release system for releasing tracer. The tracer release apparatus may be tracer injection system. The tracer release apparatus may be a tracer carrier system.

The tracer release apparatus may comprise at least one controllable valve. The tracer release apparatus may be configured to release tracer when the at least one controllable valve is open. The at least one valve may be configured to selectively control the flow of fluid through an outlet of the apparatus which may allow the tracer release apparatus to be shut in to increase the concentration of tracer molecules in a fluid volume of the apparatus. The subsequent opening of the valve may release the increased concentration of tracer. The at least one valve may be configured to selectively open and/or close in response to a well event. The at least one valve may be configured to selectively open and/or close in response to change in temperature, production flow rate or a fluid pressure in the well.

The tracer release apparatus may be configured to selectively release tracer in response to a well event and/or a chemical trigger. The at least one valve may be configured to release tracer in response to change in temperature, production flow rate and/or a fluid pressure in the well.

The tracer release apparatus may be configured to selectively release tracer in response to a signal from surface. The tracer release apparatus may be configured to selectively release tracer controlled by a timer.

The tracer release apparatus may be configured to selectively release tracer in response to contact with a particular fluid or chemical. The tracer release apparatus and/or tracer material is designed to release tracer molecules when the tracer release apparatus and/or tracer material is exposed to a target fluid i.e. oil, gas or water.

The tracer molecules released from the tracer release apparatus may form a local increased concentration of tracer also called a tracer cloud which may be transported into the reservoir.

The tracer may be transported by being pumped, injected, or placed into the reservoir. The system may comprise a pump. The pump may be a surface pump. The pump may be a downhole pump.

The tracer may be a solid, liquid or gas. The tracer may be selected from the group comprising chemical, fluorescent, phosphorescent, metallic complex, particles, nano particles, quantum dots, magnetic, poly functionalized PEG and PPGs, DNA, antibodies and/or radioactive compounds.

The tracer may comprise chemical tracers selected from the group comprising perfluorinated hydrocarbons or perfluoroethers. The perfluorinated hydrocarbons may be selected from the group of perfluoro buthane (PB), perfluoro methyl cyclopentane (PMCP), perfluoro methyl cyclohexane (PMCH).

The tracer may be chemically immobilized within and/or to the tracer release apparatus. The tracer release apparatus may comprise tracer molecules and a carrier. The carrier may be a matrix material. The matrix material may be a polymeric material. The tracer molecules may be chemically immobilized within and/or to the carrier. The tracer molecules may be chemically immobilized by a chemical interaction between the tracer and the carrier. The tracer material may be chemically immobilized in a way that it releases tracer molecules or particles in the presence of a chemical trigger.

By varying the chemical interaction between the tracer and the polymer the release mechanism and the rate of release of tracer molecules from the tracer material may be controlled. Preferably the tracer is released from the tracer carrier with an even release rate.

The carrier may be selected from poly methyl methacrylates (PMMA), poly methylcrylates, poly ethylenglycols (PEG), poly lactic acid (PLA) or poly glycolic acid (PGA) commercially available polymers or copolymers thereof. The carrier may be selected from polymers with higher rates of tracer molecules release such as polyethylene and polypropylene.

The tracer may be physically dispersed and/or physically encapsulated in the carrier. The tracer may release tracer molecules into fluid by dissolution or degradation of the carrier and/or the tracer into the fluid. The carrier may be selected to controllable degrade on contact with a fluid. The carrier may be selected to degrade by hydrolysis of the carrier. The tracer and/or the carrier may be fluid specific such that the tracer molecules will be released from the tracer as a response to a contact with a target liquid.

The tracers and/or the carrier may be chemically intelligent such that tracer molecules will be released from the tracer as a response of specific events, e.g. they respond to an oil flow (oil-active) but show no response to a water flow (water-resistant). Another group of chemical compounds can be placed in the same region, which release tracers in water flow (water-active) but show no response to an oil flow (oil-resistant). The tracers and/or the carrier may be chemically intelligent such that tracer molecules will be released from the tracer material as a response the exposure of the tracer material to a well fluid and/or a target well fluid.

The tracer molecules may be detected and its concentration measured by different techniques such as optical detection, optical fibers, spectrophotometric methods, PCR techniques combined with sequential analysis, chromatographic methods, or radioactivity analysis. The invention is not restricted to the above-mentioned techniques. The tracer molecules may be detected and its concentration measured by sampling production fluid. The sampling may be conducted at the one or more of said sampling times. The sampling may be conducted downhole downstream of the shunt chamber apparatus or at surface. Samples may be collected for later analysis.

Samples may be collected and/or measured downstream at known sampling times. Based on the measured concentrations and their sampling sequence and the well geometry the influx volumes may be calculated. The method may comprise estimating or calculating an influx profile based on the concentration and type of tracer as a function of the sampling time. The influx volumes may be calculated from transient flow models. The influx volumes may be used to estimate an influx profile of the well.

The tracer molecules may be detected by a detection device such a probe. The detection device may facilitate real time monitoring and/or analysis of the tracer in the production fluid.

The collection, detection, analysis and/or interpretation of tracer data in production fluid may be separate methods from one another and performed at different times or jurisdictions. The detection, analysis and/or interpretation of tracer in production fluid may be separate methods to the separation of phases, release of tracer cloud from the shunt chamber and/or the collection of samples. Samples may be collected and the tracer detected, analysed and/or interpreted at a time or jurisdiction which is separate and distinct from the location of well and therefore the collection of the samples.

The system may comprise a choke configured to modify, adjust or change the production flow rate. The choke may be connected to the production tubing. The choke may be a subsea choke or a surface choke. The choke may be a downhole choke.

The system may comprise a pump configured to pump fracturing fluid, acids and/or well fluid into the well. The pump may be connected to the well and/or production tubing. The pump may be a surface pump or a downhole pump.

The at least one isolation device may be selected from a dropped ball system, valve system and/or packer system.

Embodiments of the second aspect of the invention may comprise features corresponding to the preferred or optional features of the first aspect of the invention or vice versa.

According to a third aspect of the invention, there is provided a method of estimating an influx profile for at least one well fluid from a reservoir to a producing petroleum well with two or more influx zones or influx locations to a production flow;

wherein the method comprises installing tracer sources with distinct tracer materials in known levels of the well;

releasing tracer molecules from the tracer sources;

isolating at least one of the influx zones or influx locations;

pumping fluid downhole to push the tracer molecules from the well through the isolated influx zones or influx locations into the reservoir;

inducing production flow in the well;

collecting samples downstream of the two or more influx zones at known sampling times;

analysing samples for concentration and type of tracer material from said possible tracer sources; and based on the analysed concentrations calculating said contribution of flow from the two or more influx zones.

The method may comprise inducing a steady state flow. The method may comprise inducing a steady state flow condition in the production rate of the entire production flow or for at least one of the influx zones.

The method may comprise inducing multiple steady state flow conditions in the production rate of the entire production flow or for at least one of the influx zones and collecting samples.

The method may comprise releasing tracer molecules from the tracer sources into the well. The method may comprise releasing tracer molecules from the tracer sources into the annulus. The method may comprise releasing tracer molecules from the tracer sources into an isolated section of the annulus or well.

The method may comprise producing at least one well fluid from the well at a first production flow rate in the production tubing and collecting samples at the first production flow rate and then modifying the production flow rate in the production tubing to a second production flow rate and collecting samples at the second production flow rate.

The method may comprise producing at least one well fluid from the well at a third production flow rate in the production tubing and collecting samples at the third production flow rate.

The second production flow rate may be higher than the first production flow rate. Alternatively, the second production flow rate may be lower than the first production flow rate. The third production flow rate may be higher than the first and/or second production flow rate. Alternatively, the third production flow rate may be lower than the first and/or second production flow rate.

Embodiments of the third aspect of the invention may comprise features corresponding to the preferred or optional features of the first or second aspects of the invention or vice versa.

According to a fourth aspect of the invention there is provided a method of collecting samples for later analysis in estimating an influx profile for at least one well fluid from a reservoir to a producing petroleum well with two or more influx zones to a production flow;

wherein the reservoir comprises distinct tracer molecules for each of the two or more influx zones;

wherein the method comprises:

inducing production flow in the well; and collecting samples downstream of the two or more influx zones at known sampling times.

The method may comprise analysing samples for concentration and type of tracer material from said possible tracer sources; and based on the analysed concentrations calculating 11 the contribution of flow from the two or more influx zones.

The method may comprise collecting samples at a location downstream of the tracer sources at known sampling times (t) after inducing a steady state flow in the production rate of the entire production flow or for at least one of the influx zones.

Embodiments of the fourth aspect of the invention may comprise features corresponding to the preferred or optional features of the first, second or third aspects of the invention or vice versa.

According to a fifth aspect of the invention there is provided a method of estimating an influx profile for at least one well fluid from a reservoir to a producing petroleum well with two or more influx zones or influx locations to a production flow;

wherein the reservoir comprises distinct tracer sources for each of the two or more influx zones; the method comprises:

analysing samples collected at a location downstream of the two or more influx zones for concentration and type of tracer material from said possible tracer sources; and based on the analysed concentrations calculating the contribution of flow from the two or more influx zones.

The method may comprise analysing samples collected during a steady state flow in the production rate of the entire production flow or for at least one of the influx zones.

The tracer sources may have an even release rate to the well fluid.

Embodiments of the fifth aspect of the invention may include one or more features of the first to fourth aspects of the invention or their embodiments, or vice versa.

According to a sixth aspect of the invention there is provided a method of estimating an influx profile for at least one well fluid to a producing petroleum well with two or more influx zones or influx locations to a production flow, wherein the reservoir comprises distinct tracer sources for each of the two or more influx zones or influx locations in known levels of the well;

the method comprising the steps of:

providing measured concentrations and type of tracer material data from samples collected from the production flow at a location downstream of the two or more influx zones or influx locations at known sampling times; and based on the measured concentrations calculating influx volumes and/or contribution of flow from the two or more influx zones.

The method may comprise providing measured concentrations and type of tracer material data from samples collected during a steady state flow in the production rate of the entire production flow or for at least one of the influx zones.

Embodiments of the sixth aspect of the invention may include one or more features of the first to fifth aspects of the invention or their embodiments, or vice versa.

According to a seventh aspect of the invention, there is provided a method of placing tracer material in a hydrocarbon reservoir, the method comprising;

installing at least one tracer source with distinct tracer materials in known levels of the well;

releasing tracer molecules from the tracer sources into the well;

isolating at least one influx zones or influx locations in the well; and pumping fluid downhole to push the tracer molecules from the well through the isolated influx zones or influx locations into the reservoir.

The method may comprise pushing the tracer molecules into the reservoir as part of a well stimulation operation. The method may comprise pumping fluid downhole to crack the formation, pumping acid downhole to penetrate the formation and/or push the tracer molecules from the well through the isolated influx zones or influx locations into the reservoir.

The method may comprise sequentially isolating an influx zone or influx locations in the well and pushing distinct tracer molecules into the reservoir at the influx zone or influx locations. The method may comprise isolating and pumping a distinct tracer at each influx zone or influx location to be monitored in the well sequentially.

Embodiments of the seventh aspect of the invention may include one or more features of the first to sixth aspects of the invention or their embodiments, or vice versa.

According to an eighth aspect of the invention, there is provided method of estimating an influx profile for at least one well fluid to a producing petroleum well with two or more influx zones or influx locations to a production flow, wherein the well comprises tracer sources with distinct tracer materials in known levels of the well;

the method comprising the steps of:

providing measured concentrations and type of tracer material data from samples collected from the production flow at a location downstream of the tracer sources at known sampling times after production flow; and based on the measured concentrations calculating influx volumes and/or contribution of flow from the two or more influx zones.

The method may comprise providing measured concentrations and type of tracer material data from samples collected from the production flow at a location downstream of the tracer sources at known sampling times after production flow inducing steady state.

Embodiments of the eighth aspect of the invention may include one or more features of the first to seventh aspects of the invention or their embodiments, or vice versa.

BRIEF DESCRIPTION OF THE DRAWINGS

There will now be described, by way of example only, various embodiments of the invention with reference to the following drawings (like reference numerals referring to like features) in which.

DETAILED DESCRIPTION OF PREFERRED EMBODIMENTS

Figure 1:
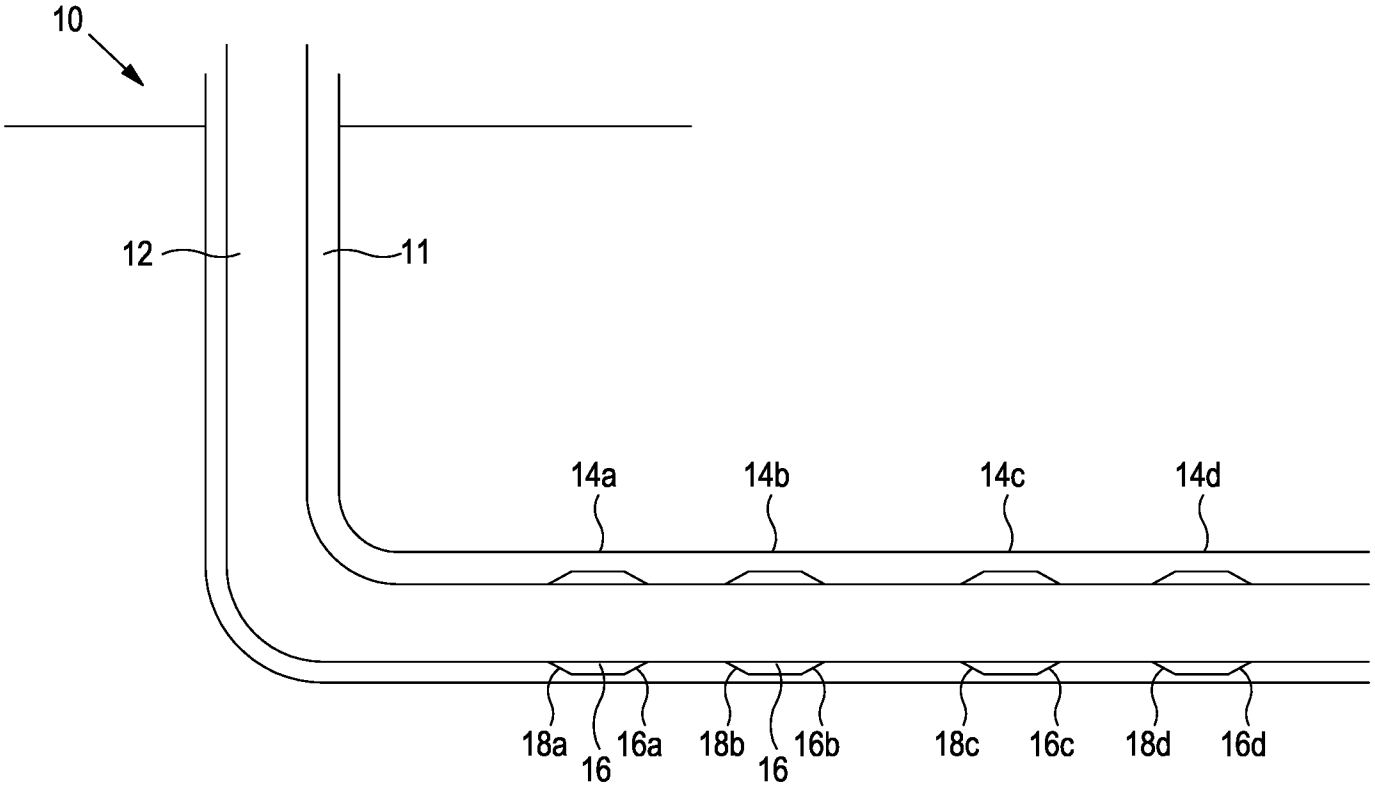
FIG. 1 is a simplified sectional diagram through a production well with a tracer release system installed in accordance with an aspect of the invention.

FIG. 1 is a simplified section through a production well 10. A central production tubing 12 is arranged in the well surrounded by annulus 11. The regions around the well 10 in a reservoir 13 are divided into a number of zones, Influx volumes of fluids enter the well 10 from the reservoir 13 into the central production tubing 12 via separate an influx location in each zone. Tracers release apparatus 16 are installed in or on the production tubing for example as integrated parts of the well completion and are arranged at known specific locations near each influx location.

In this example there are four influx locations 14*a*, 14*b*, 14*c* and 14*d* and four tracer release apparatus 16*a*, 16*b*, 16*c* and 16*d* each with a distinct tracer 18*a*, 18*b*, 18*c* and 18*d* with unique characteristics for each zone. However, there may be a different number of influx zones and/or tracer release apparatus than illustrated in FIG. 1.

In this example, the tracer release apparatus is a tracer carrier system designed to hold tracer material against the outside wall of the production tubing to outwardly vent tracer into the annulus. The tracer carrier being installed as part of the completion. In this example the tracers are designed to release molecules in controlled or even release rates into the annulus.

Figure 7A:
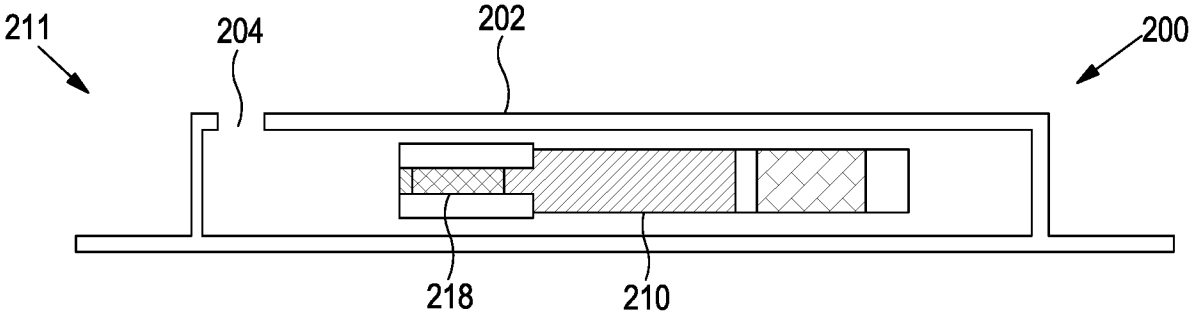
FIG. 7A shows a longitudinal sectional sketch of an alternative tracer release apparatus comprising of a mechanical tracer release system according to an embodiment of the invention.
Figure 7B:
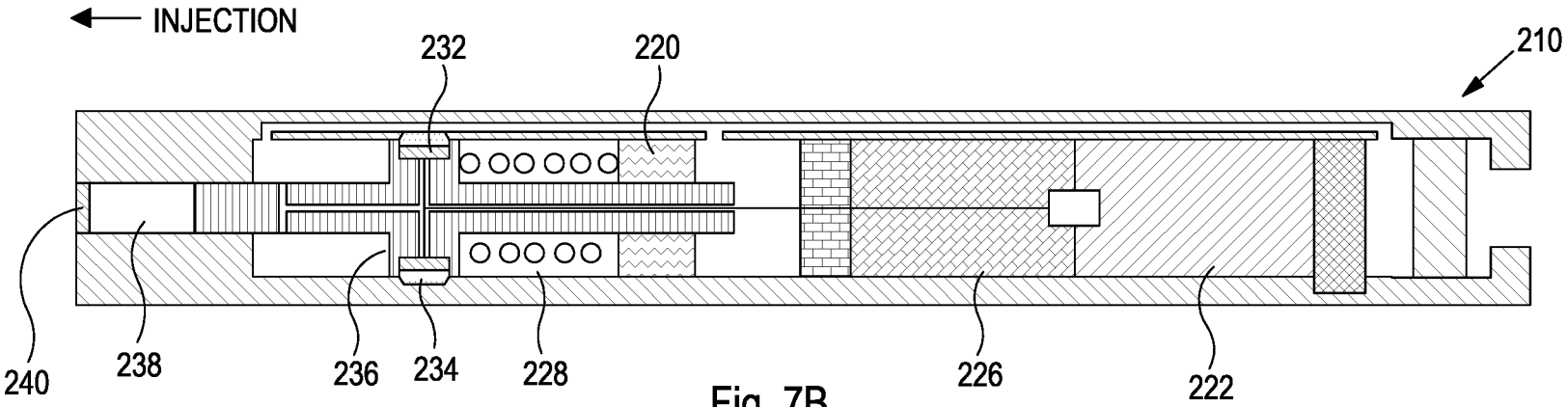
FIG. 7B shows an enlarged view of the mechanical tracer release system of FIG. 9A.
Figure 8:
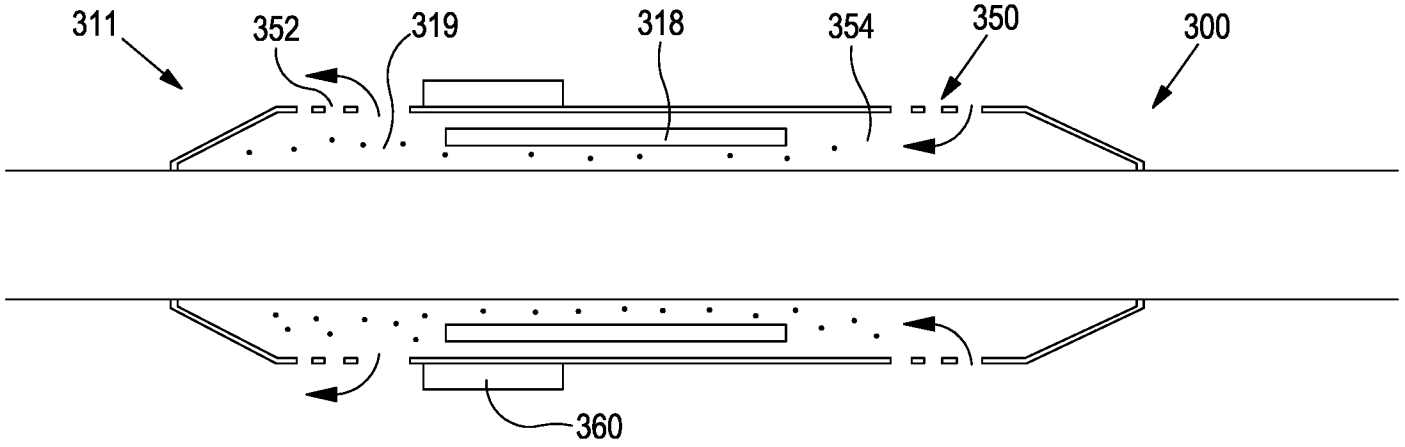
FIG. 8 shows a longitudinal sectional sketch of an alternative tracer release apparatus comprising of a valve system.

However it will be appreciated that other tracer release mechanisms may include a tracer injector device such as described in FIG. 7A or 7B or a valve device as described in FIG. 8 or a container comprising tracer designed to release tracer on exposure to a chemical or released as a function of specific events.

It will also be appreciated that the tracer release apparatus may be located in, on or around the production pipe or other components of the completion.

FIGS. 2A to 2E show the sequential and specific transport and placement of tracers 18*a*, 18*b*, 18*c* and 18*d* from the tracer release apparatus 16*a*, 16*b*, 16*c* and 16*d* into the reservoir 13 via respective influx zones 14*a*, 14*b*, 14*c* and 14*d* during well stimulation. By accurately placing distinct tracers in specific zones in the reservoir, fluid samples may be obtained downstream with tracer concentrations that provide inflow contribution from individually monitored zones.

Figure 2A:
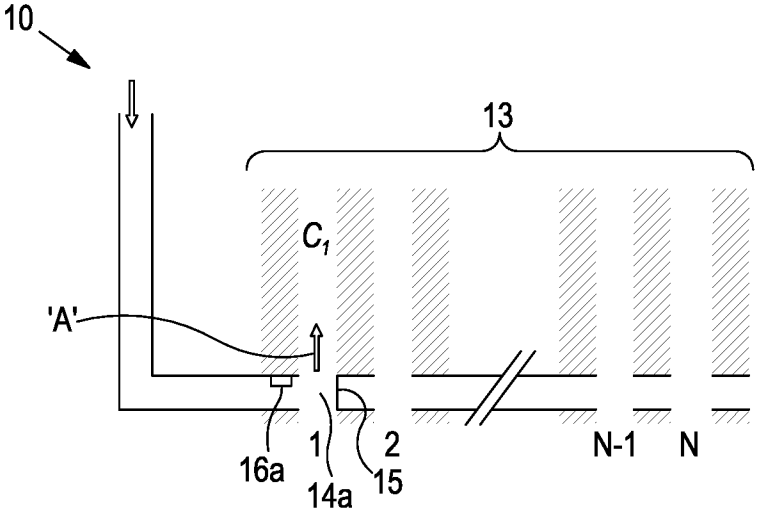
FIG. 2A to 2E are sectional diagrams through a production well with a tracer release system installed showing the sequential injection of tracer into the reservoir in accordance with an aspect of the invention.
Figure 2B:
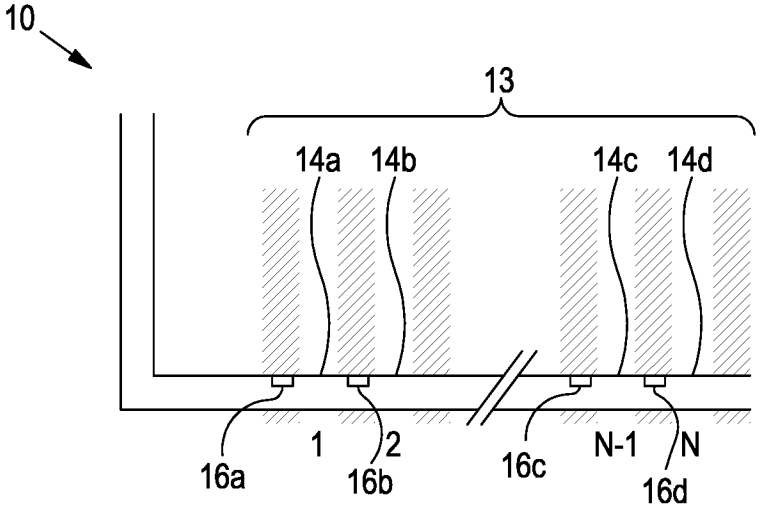

As shown in FIG. 2A tracer release apparatus 16*a*, 16*b*, 16*c* and 16*d* are installed as part or the completion and cemented in place. FIG. 2B shows a first influx location 14*a* is isolated by an isolation device 15 for example a valve, packer or a dropped ball mechanism arranged in the well. Once the zone around a first influx location 14*a* is isolated, fracturing fluid is pumped at pressure into the well to crack the formation at the first influx location 14*a* and acid is injected to penetrate deep into the formation.

Tracer molecules are released from the tracer release apparatus building up a very high concentration of tracer in the annulus at the first influx location. In this example the tracer molecules are designed to gradually release tracer at known release rates over a period of time when the tracer release apparatus are installed. However, it will be appreciated that the tracer release apparatus may be designed to release tracer in response to exposure to a specific fluid or chemical. Additional or alternatively the tracer release apparatus may be designed to release tracer molecules in response to a specific well condition, well event, a signal from surface or after a period of time. The tracer may also be designed to release tracer as a sudden burst, shot or dose of tracer rather than a gradual release over time.

Fluid is then pumped downhole to transport the high concentration of the tracer molecules from the isolated first influx location into the reservoir 13 via influx zones 14*a* as shown by arrow A in Figure B.

Figure 2C:
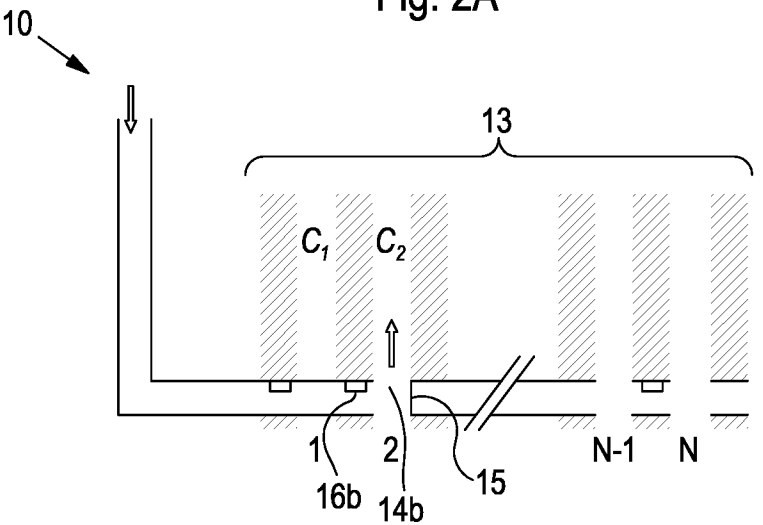
Figure 2D:
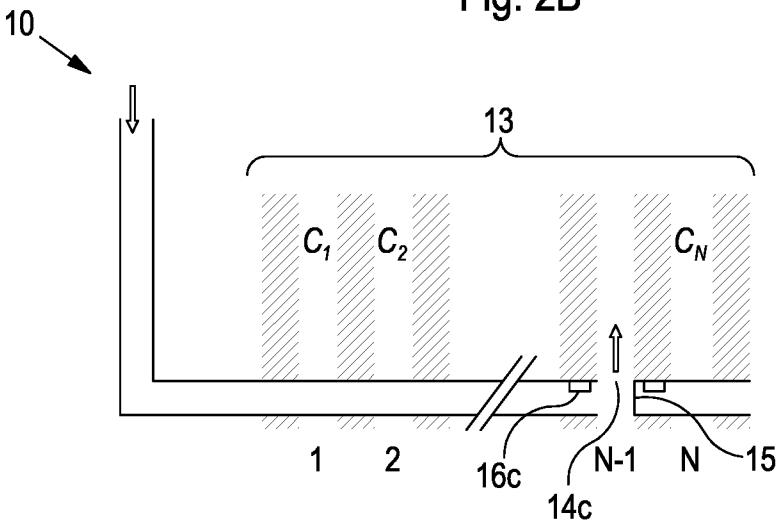
Figure 2E:
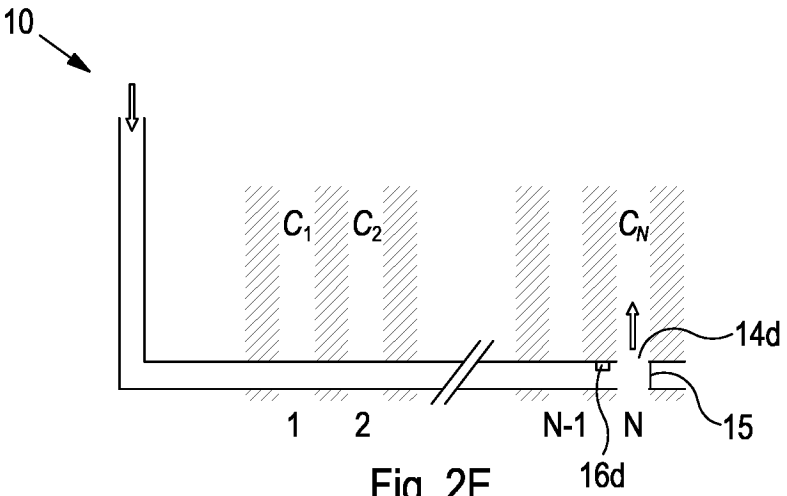

As shown in FIGS. 2C to 2E the procedure of placing a distinct tracer into the formation and reservoir is repeated at each individual influx location 14*b*, 14*c*, and 14*d* by isolating each influx location in turn, by closing off other influx points using isolation device 15 e.g. valves, packers or a ball-drop system. Each influx location is in turn stimulated by high fluid pressure and acid, and a high concentration of distinct tracer molecules is built up at each location before being pushed into each respective influx zone.

Although the transport of the tracers into the reservoir formation is described above as part of a well stimulation operation it will be appreciated that the transport of the tracer into the reservoir may be carried out at a later step separate to the well stimulation operation. It will be appreciated that isolation of the individual influx locations can be achieved by various means. One example is the use of coiled tubing with inflatable packers' systems designed for acid stimulation operations. Additionally or alternatively a drop ball system may be used that isolate and direct fluid into isolated parts of the well.

Referring to FIG. 2B a specific volume of fluid is pumped in each location as follows: First, a volume $V_1$ is injected into the reservoir at influx location 14*a*, while the other parts of the reservoir are isolated. As shown in FIG. 2C the influx zone 14*a* to the reservoir at location 1 is subsequently closed and influx location 14*b* is opened and a volume $V_2$ is injected into the reservoir at influx location 14*b*, while the other parts of the reservoir are isolated. This process is repeated for influx locations 14*c* and 14*d* as shown in FIGS. 2D and 2E until a fluid volume $V_i$ has been injected into the reservoir at all locations i=1, 2, . . . , N.

Using this system a known volume of fluid is injected into the reservoir at each influx zone or location. It can be an advantageous if the volume is equal for each location. However this is not a requirement.

Although FIGS. 2A to 2E describe the sequential transport of tracer into the reservoir in order from the influx location 14*a* closest to surface to influx location 14*d* furthest downhole, it will be appreciated that the sequence may be in any order and may be arbitrary. However, if a ball drop system is used, the zone furthest from the well head may be stimulated first, and consequently the order of injection may be reversed compared to the example described in FIGS. 2A to 2E. It will also be appreciated that tracers may not be positioned or pumped into the reservoir at some zones.

During installation of the tracer release apparatus and up until the injection of fluid, tracer is released from the tracer release apparatus. The released tracer forms a local high concentration of tracer in the vicinity of each of the installation locations. During the injection of fluid into the reservoir, the released tracer mixes with the injection fluid due to dispersion, as well as other physical effects such as molecular diffusion, spontaneous imbibition etc. and creates a semi-constant concentration in the reservoir fluid.

After the fluid volumes $V_1$, $V_2$, $V_3$ and $V_4$ and tracers 18*a*, 18*b*, 18*c* and 18*d* have been injected into the reservoir 13 at all locations 14*a*, 14*b*, 14*c* and 14*d* the well is prepared for production.

Figure 3A:
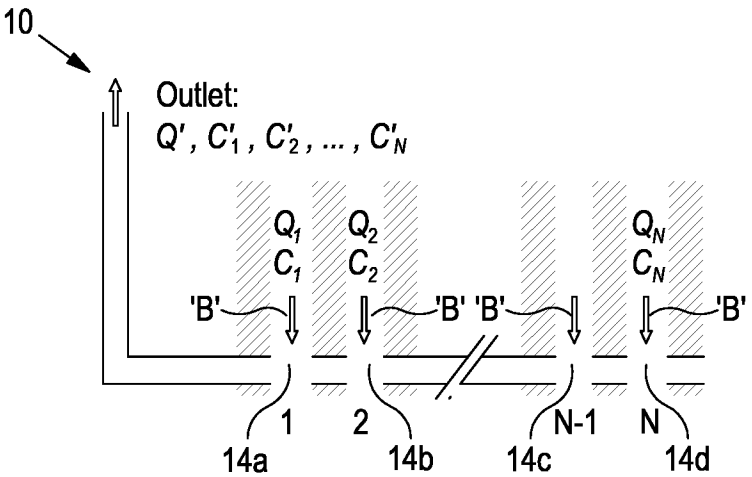
FIGS. 3A and 3B are simplified sectional diagrams through a production well showing flow of tracers from the reservoir into the well during production in accordance with an aspect of the invention.

As shown in FIG. 3A production preparation typically includes opening of all influx zones 14*a*, 14*b*, 14*c* and 14*d* for production (shown as arrow "B" in FIG. 3*a*). However, it may be appreciated that some zones may be kept closed for a period of time, or not opened at all.

During production, the rate Q' of each phase is recorded downstream of the influx locations such as at surface. Additionally, fluid samples are taken at downstream of the influx location such as at surface and concentrations ($C_1$, $C_2$, . . . , $C_N$) of the tracers are measured in the fluid samples.

During production the time to travel to surface from each influx inlet points is not the same, because the distance from the influx locations to the point of sampling such as surface are not the same for each influx locations and because the fluid velocity vary (typically increases) as the fluid moves from the influx locations along the well bore towards the surface. This implies that tracer found at the point of sampling entered the well-bore at different times, that can vary by several minutes or even hours, depending on the specific conditions in the well.

During a period of sampling it is advantageous to keep the fluid production rate constant to ensure that the tracer concentration from each influx locations changes little over time. This generally cannot be achieved if a transient in the production flow is present.

Figure 3B:
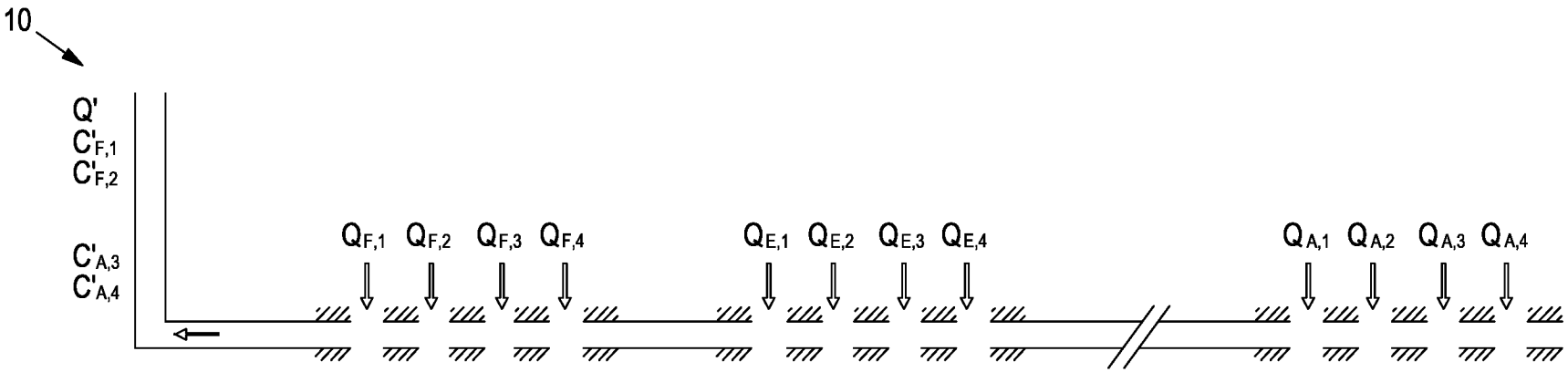

Maintaining a steady state flow condition allows a comparison of the concentration and rates at the influx locations to the measured concentration and rates at the sampling point, such as at surface. FIG. 3B shows an extension of the system of FIG. 3A applied to multiple zones in the well.

The development of practical expressions to be used are easier if there is negligible mixing as the tracers are moved with the carrying fluids towards the surface. This imply that we would like the dispersion to be small, which can be achieved in the well rates are large enough to have turbulent conditions in the well.

The calculation of rate fractions from each influx location into the production flow uses the fundamental principle of mass-conservation that applies for each tracer in the individual tracer systems. If we define a small control volume $V=Q\cdot\Delta t$, corresponding to a sample at surface, and if we assume that no tracer mass leaves or enters this control volume during transport from the entry point to the sampling point, then the mass in this control volume is conserved.

The mass of a tracer i=1, 2, . . . , N, entering into the wellbore with its carrying fluid at a rate $Q_i$ and a concentration $C_i$, must equal the mass topside where the rate Q' and concentration $C'_i$ is measured. We thus have:

$$m_i=Q_i\cdot C_i\cdot\Delta t=Q\cdot C'_i\cdot\Delta t \tag{1}$$

Eliminating the time interval and re-arranging we can write $$Q_i/Q'=C'_i/C_i \tag{2}$$

This relationship shows that the fraction of fluid originating from influx location i, $f_i=Q_i/Q$ is given as the concentration of tracer i at the influx location relative to the concentration of that tracer in the sample.

The concentrations $C_i$ are unknown—however, we can assume that these concentrations are similar for each reservoir volume attached to individual influx locations, in other words that $C_1=C_2=C_3=\ldots=C_N=k$.

We would like to express the unknown k by known properties. If we use the relationship $Q_i/Q=C_i'/k$, a summation over all i gives:

$$\sum_{i=1}^{N}\frac{Q_i}{Q}=\sum_{i=1}^{N}\frac{C'_i}{k} \tag{3}$$

The constant Q can be taken out of the summation and continuity for the flow ($Q=\Sigma Q_i$) gives that the left hand side of Equation (3) must equal 1. Since k is a constant it can also be moved out of the summation and we obtain the desired result $$k=\sum_{i=1}^{N}C'_i \tag{4}$$

Finally, we can express the desired inflow contribution from each zone as $$f_i=C'_i/\sum_{i=1}^{N}C'_i \tag{5}$$

This relationship assumes that no tracer mass leaves or enters the control volume during transport from the influx location to the surface. In practice this means that mixing in the wellbore must be negligible, which occurs if the dispersion is small. This is a valid assumption if the flow in the wellbore is turbulent, which is a condition met in many cases relevant for the technology.

Equation (5) developed above is based on the approximation that all concentrations $C_1, C_2, \ldots, C_N$ are equal. To ensure that this approximation is good various operational steps can be tuned. First, it is possible to ensure that the amount of tracer released from the individual tracer systems is equal, by equating the amount available in each system. Additionally, the release parameters can be adjusted to ensure that the gradient dC/dt is constant. Finally, the amount of fluid used to place the tracer in the reservoir can be equated so that a similar volume is used to push the tracer into the reservoir.

In some cases, it can be desirable to have a flexibility to choose the parameters affecting individual concentrations $C_1, C_2, \ldots, C_N$. If the parameter choices are made systematically and recorded it is possible to take this into account and revise relation (5) accordingly. As an example, let us assume that the amount of tracer in system #j is $\alpha$ times the amounts in the other systems, i.e. that $$C_1 = C_2 = \cdots = \frac{1}{\alpha} C_j = \cdots = C_N = k.$$

in that case we find that $$\sum_{i=1}^{N} \frac{Q_i}{Q} = \sum_{i=1}^{j-1} \frac{C_i'}{k} + \frac{C_j'}{\alpha k} + \sum_{i=j+1}^{N} \frac{C_i'}{k} \tag{6}$$

and hence that $$f_i = C_i \Big/ \left( \sum_{i=1}^{j-1} C_i' + \frac{1}{\alpha} C_j + \sum_{i=j+1}^{N} C_i' \right) \tag{7}$$

for systems i=1, 2, . . . , j−1, j+1, . . . , N. For system #j we have $$f_j = \frac{1}{\alpha} C_j \Big/ \left( \sum_{i=1}^{j-1} C_i' + \frac{1}{\alpha} C_j + \sum_{i=j+1}^{N} C_i' \right) \tag{8}$$

Similar expressions can be developed for other special cases, as long as the relationship between the individual concentrations can be quantified.

In one embodiment of the invention the fraction of oil and water along production wells can be obtained. The inflow contribution per influx location along the well, established using the expressions developed above are available for each phase for which a system is installed.

For example, if water and oil tracer specific systems are installed at each influx location point, the production allocation of both oil ($fo_i$) and water ($fw_i$) along the wellbore is available, by use of expression (5) using oil and water tracer concentrations, respectively. To obtain the water and oil rates at specific influx location points (i) we can then simply multiply the rates of oil ($Q'_o$) and water ($Q'_w$) at the surface to the respective allocation factors. The expressions for oil and water then read $Q_{o,i}=fo_i \cdot Q'_o$ and $Q_{w,i}=fw_i \cdot Q'_w$.

In the event that there is gas produced at the surface, it is necessary to take this into account when calculating the downhole oil rate. In most cases this can be achieved by applying the formation volume factors $b_o$ and $b_g$.

The quantities Q', as well as the concentrations $C_1, C_2, \ldots, C_N$ represents values of corresponding continuous functions of time Q'(t) and $C_1$ (t), $C_2$(t), . . . , $C_N$(t). In the descriptions (figures included) all quantities are for brevity denoted without the time variable. This notational choice does not in any way restrict the derived expressions and methods to one specific time ($t_i$) or to a series of discrete times ($t_1, t_2, \ldots, t_M$). All embodiments of the invention are therefore unrestricted by the discrete representation used in the description given herein. A series of fluid samples, e.g., would give a time-series of results. A measurement system that could provide continuous functions Q'(t) and $C_1$(t), $C_2$(t), . . . , $C_N$(t) would likewise provide continuous results.

Fluid Rate Information from Tracer Signals

Mass conservation of a tracer in a flow stream may be described by a partial differential equation known as the advection-dispersion equation. It follows directly from the advection-dispersion equation that fluid rate and tracer signals in the form of concentration versus time are related, and that concentration signals therefore bear information about fluid rates in a system.

One specific form of the advection-dispersion equation for single phase transport in a one dimensional system, given as:

$$\frac{\partial C}{\partial t} + U \frac{\partial C}{\partial x} - D \frac{\partial^2 C}{\partial x^2} = 0 \tag{9}$$

where C(x,t) is concentration (unit $M/L^3$), U is velocity of the moving phase (unit L/T) and D is dispersion ($L/T^2$) of the tracer in the one dimensional system. In Equation (9) it is assumed that dispersion and velocity are constant and thus independent of time and the spatial coordinate. This equation can be solved analytically or numerically.

Figure 4B:
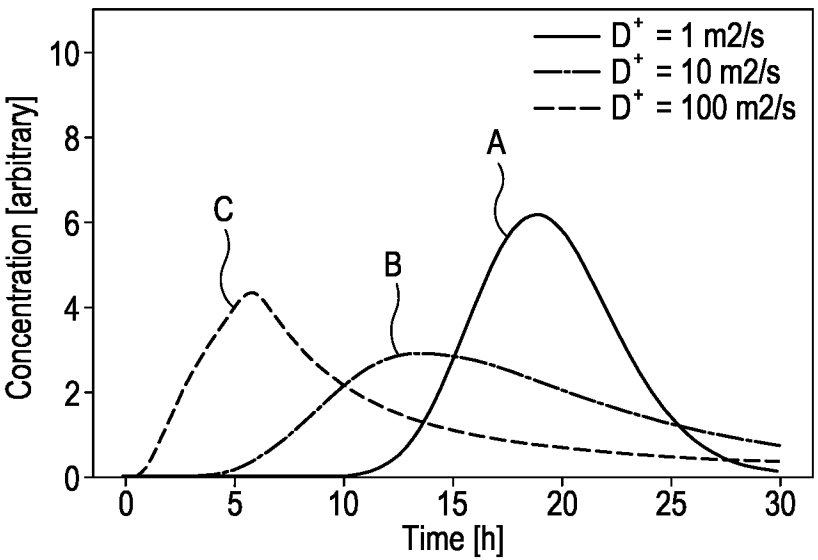
FIG. 4B is a graphical representation of example tracer concentration levels measured at surface at a flow rate of 200 m3/day of where dispersion is varied in accordance with an aspect of the invention.

Examples of solutions to this equation, with initial conditions:

$$C(x,0)=0 \text{ for } x \geq 0$$

$$C(0,t)=C_0 \text{ for } \tau \geq t \geq 0$$

$$C(0,t)=0 \text{ for } t \geq \tau$$

$$C(\infty,0)=0 \text{ for } t \geq 0$$

for various values of the parameters $C_0$, $U=Q/(\pi r^2)$, t, and D are displayed in FIG. 4B.

Figure 4A:
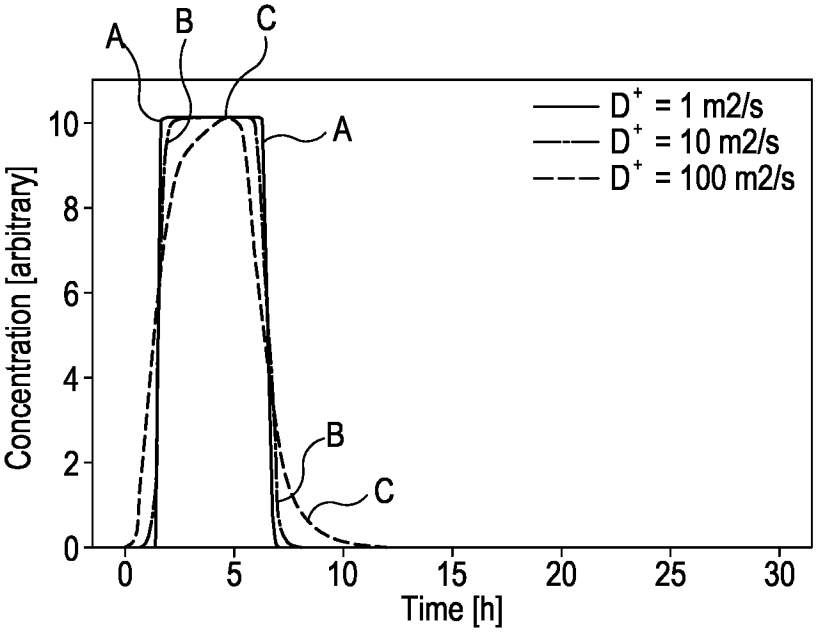
FIG. 4A is a graphical representation of example tracer concentration levels measured at surface at a flow rate of 2000 m3/day of where dispersion is varied in accordance with an aspect of the invention.

FIGS. 4A and 4B shows graphical representations of examples of solutions to the convection-dispersion equation for various parameter values. Data is based on a well length L=2000 m, an inner well radius r=0.15 m and $\tau$=5 h. An arbitrary value $C_0$=10 was set in all cases. The parameter $\tau$ is the duration of a constant concentration in the boundary condition given above. It is set equal for all cases displayed in FIGS. 4A and 4B, hence the mass is the same in all cases.

In a preferred embodiment t corresponds to the time from production start until the concentrations $C_1, C_2, \ldots$ deviate from their initial constant levels by a level above an accepted uncertainty for a particular application (e.g. 10%, 25%, 50% etc.).

As shown in FIG. 4A the dispersion was varied at 1, 10 and 100 m2/s which changed the appearance of the resulting tracer curve but all of the curves maintained a generally rectangular shaped curve. In FIG. 4A the rectangular shaped curve is maintained due to a high flow rate in this example a rate Q=2000 $m^3$/day was applied. In FIGS. 4A and 4B Dispersion at 1 m2/s is shown as curve "A", dispersion at 10 m2/s is shown as curve "B" and 100 m2/s as curve "C".

However, FIG. 4B shows how the appearance of the tracer curves change to generally bell-shaped curves for each of the dispersion values (1, 10 and 100 m2/s) when the well flow rate is reduced to Q=200 $m^3$/day.

If the well flow rates is high then the dispersion of the tracer during its transport in the well to surface is small and mixing in the wellbore is negligible this results is a high gradient concentration spike followed by a high gradient drop when the tracer has reached the surface. In contrast, if the well flow rate is low then the tracer spends more time dispersing and mixing in the well during its transport this results is a lower gradient concentration spike followed by a lower gradient drop when the tracer has reached the surface. From FIGS. 4A and 4B it is clear that the appearance of tracer curves depends on the characteristics of the system in which the tracer is transported.

The characteristics of the tracer signals can be analysed by comparing the time scales in the problem. Three time-scales of particular interest are:

1) $t_1$ is the time to travel from influx location to surface by advection ($t_1=L\cdot\pi r^2/Q$);
2) $t_2$ is a characteristic time for mixing $t_2=L^2/D$; and
3) $t_3$ is the duration of constant influx concentration ($t_3=\tau$).

Figure 4C:
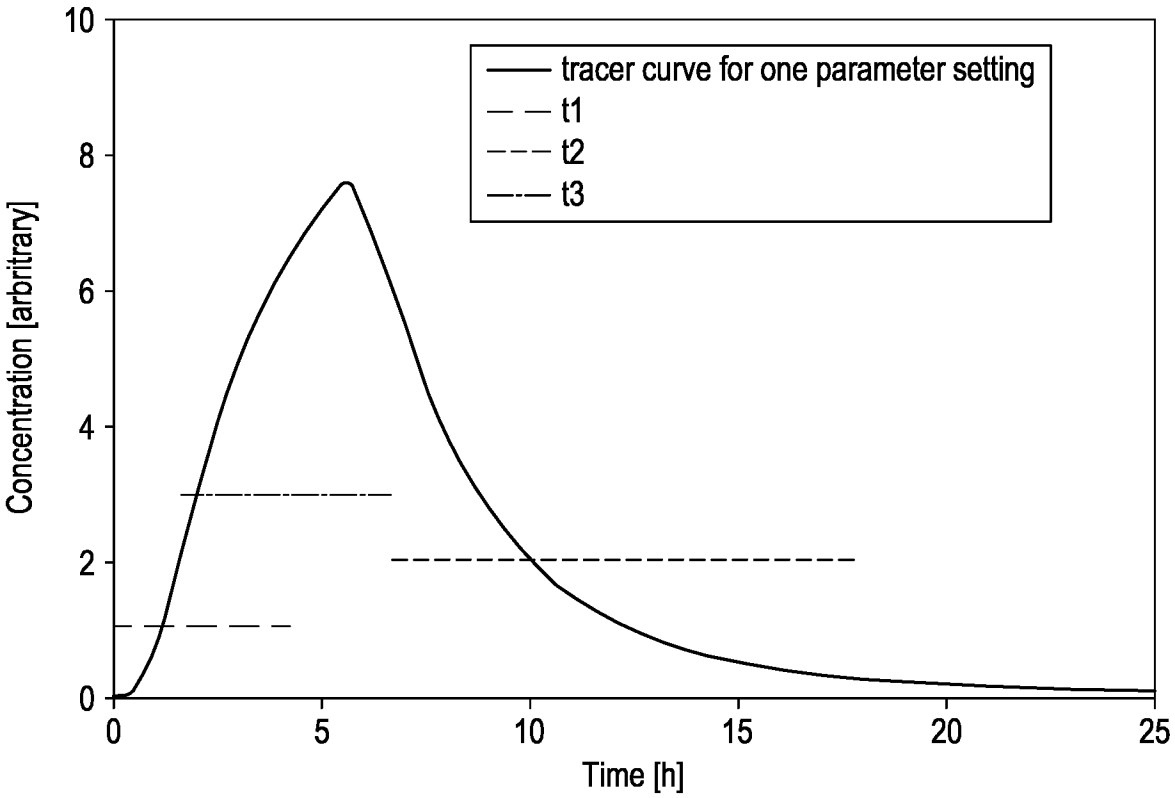
FIG. 4C. is a graphical representation of example tracer concentration levels measured at surface, with characteristic time scales (t1, t2 and t3) in tracer signals annotated as lines.

FIG. 4C is a graphical representation of example tracer concentration levels measured at surface, with characteristic time scales ($t_1$, $t_2$ and $t_3$) in tracer signals annotated as lines.

The characteristic times of the tracer signals are valuable to assess the suitability of signals from one particular parameter setting to provide useful information. For example to assess if the dispersion is too large for a particular parameter setting to provide accurate tracer signals, $t_1$ and $t_2$ can be compared. In similar manners $t_2$ and $t_3$ can be compared, as well as $t_1$ and $t_3$. Applied to the embodiment described here, the characteristic times may be used as shown in FIG. 4C, to determine suitable rate settings in the well such as appropriate sample frequencies.

Steady state flow occurs when $t_3$ are larger than $t_1$ such as shown in FIG. 4A and also large compared to $t_2$. For two or more sources of well fluid meet at a junction and results in a combined flow with a flow rate of $Q=Q_1+Q_2+\ldots+C_N$. One such example is where tracer from one influx location meet the production flow in the wellbore. Another example is the junction of individual laterals and the main well-bore in multilateral wells.

Figure 5:
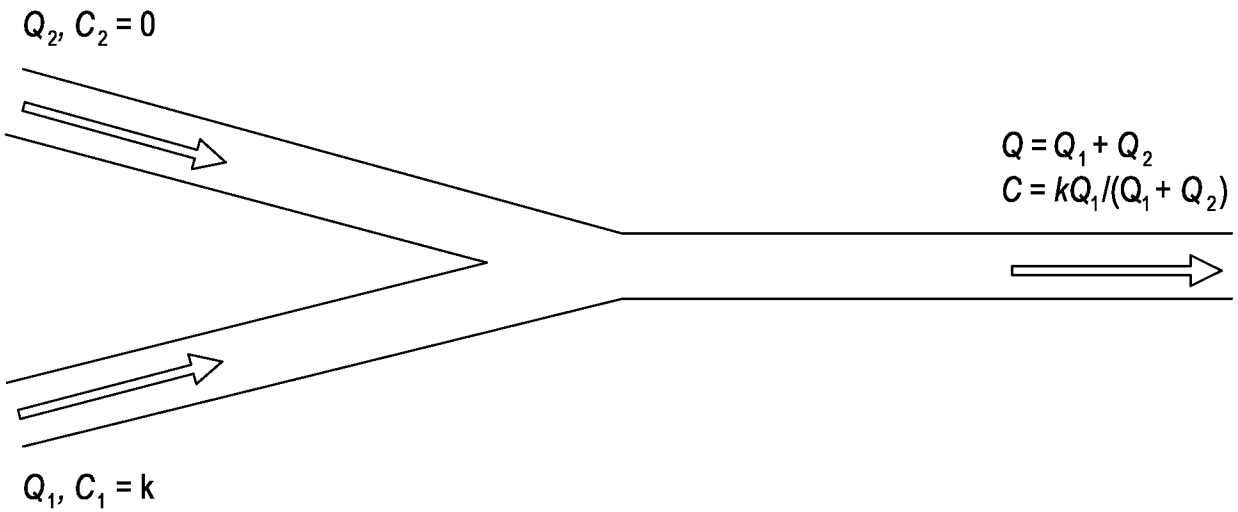
FIG. 5 is a simplified sectional diagram showing concentration downstream of a junction from upstream concentrations and rates in accordance with an aspect of the invention.

Downstream of a junction the tracer concentration is diluted given as $C=C_i\cdot Q_i/(Q_1+Q_2+\ldots+Q_N)$, where $C_i$ is the concentration in the flow carrying tracer to the junction at a flowrate $Q_i$. Hence the downstream concentration depends on the flowrates into the junction and the concentration in the flow. A simple illustration where two fluid streams meet is illustrated in FIG. 5. FIG. 5 show the concentration C downstream of a junction, given from upstream concentration and rates. In one upstream flow of the junction $Q_2$, $C_2=0$, in a second upstream flow $Q_1$, $C_1=k$ and in the combined downstream flow of the junction $Q=Q_1+Q_2$ and $C=kQ_1/(Q_1+Q_2)$.

Although a transient or change in production flow is not required to calculate relative inflow from each zone the method may comprise adjusting the production flow rate to a set a different steady state condition in the well to verify that the method may provide reliable results at different flow conditions.

In a production well the flow rate into the well bore from individual sections depend on the reservoir pressure as well as the pressure in the well. The latter can be adjusted by various means—e.g. by changing choke-settings or other means that increases or decreases flowrate at the surface. Such adjustments will change the relative inflow from individual sections of the well. From example in FIG. 5 it is clear that such adjustments will change the concentrations of tracer measured at the surface.

Figure 6:
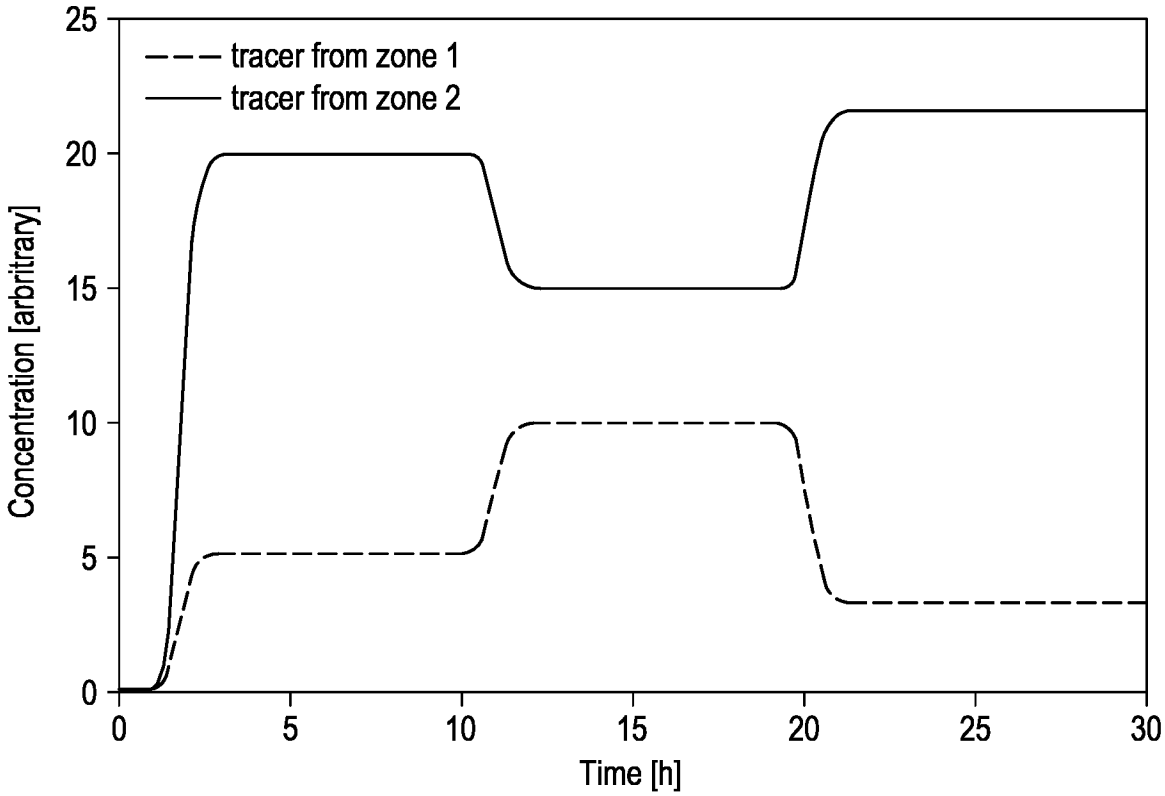
FIG. 6 is a graphical representation of example tracer concentration levels measured at surface for three different steady state conditions in accordance with an aspect of the invention.

If the characteristics of the flow and the initial conditions are such that tracer concentrations into the wellbore at the influx location from the reservoir are quasi-constant over time ($t_3$ is large) and rate adjustment changes concentrations at the surface we will expect behaviour with step-wise changes to the concentration, similar to that seen in FIG. 6.

FIG. 6 is an illustration of measured surface concentrations in a well as function of time when the tracer concentrations at an influx location is constant and the surface tracer concentrations are measured during a first steady state condition, the production flow rate is adjusted and the tracer concentrations is measured at a second steady state condition different to the first steady state condition.

The example concentrations provided in FIG. 6 is based on a case with only two inflow zones, denoted zone 1 (dashed line) and zone 2 (solid line). The contribution to the total flow from zone 1 is given as $f_1=C_1/(C_1+C_2)$, where $C_1$ and $C_2$ are concentrations at surface of tracer from zone 1 and 2 as described by Equation (5).

The fraction from zone 2 is given as $f_2=C_2/(C_1+C_2)$. If changes to the well are applied (e.g. choke charges) that affect the distribution of inflow rates, this will affect the concentrations. In the example shown in FIG. 6, for time below 10 h the well conditions are set so that zone 2 contributes four times more fluid than zone 1 ($Q_2=4\cdot Q_1$) and the concentration of tracer from zone 2 (20 on the graph) is thus four times larger than the concentration from zone 1 (5 on the graph). The fraction of fluid produced from zone 1 is 5/(20+5)=20%. and the fraction from zone 2 is 20/(20+5) =80%. At a time t=10 h the choke settings are changed so that the inflow contribution to zone 1 is increased from 20% to 40%. This is reflected in the concentration of tracer from zone 1—that doubles from 5 to 10. At the same time, the concentration from zone 2 drops from 20 to 15. A time t=20 h the well conditions are again changed to a third production rate where $Q_2=5Q_1$ and a third measured concentration during steady state condition is measured at surface at $C=20\cdot Q_1/(6\cdot Q_1)=10/3\sim3.3$.

Additionally or optionally analysing reservoir tracer samples of the initial production fluid from each influx zone addition information on the influx profile of the well may be provided.

As an example the initial high concentration tracer from the influx fluid in each zone decreases as production continues until it reaches a steady state constant influx tracer concentration. The rate of change in tracer concentration is a function of cumulative production. Influx zones with high inflow rates flush out the tracer faster than zones with low inflow rates thereby preserving the high concentration of tracer molecules and generating a profile with steep rates of decline In contrast, the concentration of tracer flushed out of a low inflow rate becomes more diluted as mixes with production flow and travels to the surface. As a result the tracer concentration profile presents a noticeably less steep rate of decline when compared to a high-performing zone By modelling the flush out of the tracer during initial production when the tracer concentration is high and decreasing as a function of cumulative volume and comparing the measured concentrations from samples to simulated data the percent of total inflow for each monitored zone may be identified.

Additionally or optionally analysis may be performed on the arrival time at surface of tracer from the reservoir during the initial production fluid.

During the production the time to travel to surface from each influx zone is not the same, because the well geometry and distance from the influx locations to the surface are not the same for each influx locations and because the fluid velocity vary (typically increases) as the fluid moves from the influx locations along the well bore to the surface.

During initial production, the distinct tracer in the reservoir at each influx zones enters the production flow and is carried to the sampling point where the fluid is sampled to measure the high concentration peaks as they arrival at surface. The volume between the arrival of each tracer peak is proportional to the inflow that occurs upstream of each tracer. The measured results are compared with simulations to determine the inflow distribution. The system may use an iterative technique that assumes a specific scenario of inflow distribution, simulates the arrival time of the tracer peaks based on that scenario, and compares the simulated results to the actual peak arrivals. After several iterations, the system converges on a solution that provides an inflow distribution that best fits the actual measured data.

FIG. 7A shows an alternative tracer release system 200 comprising an enclosure 202 comprising a mechanical release system 210, tracer 218 and an outlet 204 for releasing the tracer into the annulus 211. FIG. 7B is an enlarged view of the tracer release system 210.

The tracer release system 210 comprises a timer 222, relay 224, and battery 226 to control the tracer release. The system also comprises a spring 228, spring tension nut 220, melt ring 232, slips 234, ejection piston 236, compensated fluid chamber 238 and burst disk 240. The timer 222 which may be controlled by surface controls the actuation of the ejection piston which acts on the tracer to release the tracer into the annulus.

FIG. 8 shows an enlarged section of an alternate tracer release apparatus arrangement 300 for exposing tracer material 318 to fluid from the annulus and releasing tracer molecules 319 into the annulus 311. The tracer release apparatus 300 is installed on a production tubing at a known influx location. The tracer release apparatus has an inlet 350 in fluid communication with the annulus 311 and an outlet 352 in fluid communication with the annulus 311. Arrows in FIG. 8 denote the direction of fluid travel.

The tracer release apparatus 300 has a tracer chamber 354 which comprises a tracer material 318. The tracer material may be mounted in the tracer chamber to allow fluid to contact the tracer material and pass around the tracer material in the tracer chamber 354. The tracer material 318 is designed to release tracer molecules or particles into the tracer chamber when exposed to a target fluid.

A valve assembly 360 is designed to open and close the outlet 352 in response to changes in differential pressure in fluid flow. In the example shown in FIG. 8, the valve assembly is mounted on an outside wall of the tracer chamber. However, it will be appreciated that the valve assembly may be mounted on an inside wall of the tracer chamber.

The valve assembly shown in FIG. 8 is a differential pressure valve configured to open or close when the valve is exposed to a differential pressure which reaches a predetermined level. For example, when a differential pressure created by a change flow in the well. It will be appreciated that an alternative valve type may be used. The valve may be an electrically actuated valve, a mechanical valve and/or thermodynamic valve. The valve may be a controllable valve. The valve may be configured to selectively open and/or close in response to a well event. The valve may be configured to selectively open and/or close in response to a signal from surface and/or in response to a change in temperature, pressure and/or velocity. The valve may be configured to selectively open and/or close in response to at least one electronic signal.

When the valve is opened tracer molecules are released into the annulus where it may subsequently be pushed into the reservoir. The valve may remain open to build up the concentration of tracer molecules in the annulus.

By providing a tracer release apparatus with at least one valve configured to selectively control the flow of fluid through the at least one outlet may allow the apparatus to be shut in at one or more times to increase the concentration of tracer molecules in a fluid volume of the apparatus before it is released into the annulus by opening the valve.

The invention provides a method and system of estimating an influx profile for at least one well fluid from a reservoir to a producing petroleum well with two or more influx zones or influx locations to a production flow. The method comprises installing tracer sources with distinct tracer materials in known levels of the well and transporting tracer molecules from the tracer sources in the well into the reservoir. The method comprises inducing production flow in the well from the reservoir into the well, collecting samples downstream of the two or more influx zones at known sampling times and analysing samples for concentration and type of tracer material from said possible tracer sources. Based on the analysed concentrations the method calculates said contribution of flow from the two or more influx zones.

The system is able to selectively position tracer sources downhole, release a tracer cloud of high concentrations of tracer molecules from the tracer sources into the annulus which can then be selected and accurately transported into the reservoir.

A benefit of the method and system is that known amounts of tracers may be accurately positioned into the reservoir at various locations along the well.

A further benefit of the method and system is that is capable of determining the distribution of inflow rates during steady-state conditions without requiring a transient in the production flow or requiring the shutting in of the well.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as "up", "down", "top", "bottom", "upper", "lower", "upward", "downward", "horizontal", "vertical", "and the like are used herein to indicate directions and locations as they apply to the appended drawings and will not be construed as limiting the invention and features thereof to particular arrangements or orientations.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention as defined by the appended claims.

The invention claimed is:

1. A method of estimating an influx profile for at least one well fluid from a reservoir to a producing petroleum well with two or more influx zones or influx locations to a production flow, wherein the method comprises:

installing at least one tracer source with distinct tracer materials in known levels of the well;

transporting tracer material from the at least one tracer source into the reservoir;

inducing production flow in the well from the reservoir into the production well;

collecting samples downstream of the two or more influx zones at known sampling times;

analysing samples for concentration and type of tracer material from said at least one tracer source; and based on the analysed concentrations calculating contribution of flow from the two or more influx zones.

2. The method according to claim 1 wherein the least one of the tracer source is installed downstream, upstream or adjacent to at least one of the influx zones.

3. The method according to claim 1 wherein the well fluid is at least one of oil, gas and/or water.

4. The method according to claim 1 comprising releasing tracer molecules into the well and/or well annulus.

5. The method according to claim 1 comprising forming a local increased concentration of tracer before transporting the tracer material into the reservoir.

6. The method according to claim 1 comprising inducing production flow to allow tracer material in the reservoir to enter the production flow through the two or more influx zones and propagate downstream with the production flow.

7. The method according to claim 1 comprising transporting tracer material into the reservoir through each of the two or more influx zones or influx locations.

8. The method according to claim 1 comprising transporting a first tracer through a first influx zone and a second tracer through a second influx zone.

9. The method according to claim 1 comprising transporting the tracer material through each of the influx zones or influx locations sequentially and/or simultaneously.

10. The method according to claim 1 comprising transporting the tracer material from the well into the reservoir by pumping a fluid downhole to push the tracer material into the reservoir.

11. The method according to claim 1 comprising isolating at least one influx zone or influx location in the well before transporting the tracer material from the well into the reservoir.

12. The method according to claim 1 comprising isolating each influx zone or influx location and transporting the tracer material from the influx zones or influx locations into the reservoir sequentially.

13. The method according to claim 1 comprising inducing a steady state flow condition in the production rate of the entire production flow or for at least one of the influx zones.

14. The method according to claim 1 comprising inducing multiple steady state flow conditions in the production rate of the entire production flow or for at least one of the influx zones and collecting samples.

* * * * *